United States Patent [19]

Bergvall

[11] Patent Number: 4,677,927

[45] Date of Patent: Jul. 7, 1987

[54] ELECTRONIC FANCY SEWING MACHINE HAVING MEANS FOR ADJUSTING THE DRIVING MEANS OF A CLOTH FEEDER DURING A FEEDING PHASE

[75] Inventor: Bengt A. Bergvall, Huskvarna, Sweden

[73] Assignee: Husqvarna Aktiebolag, Huskvarna, Sweden

[21] Appl. No.: 848,390

[22] Filed: Apr. 4, 1986

[30] Foreign Application Priority Data

Apr. 9, 1985 [SE] Sweden ..... 8501733

[51] Int. Cl.[4] ..... D05B 3/02

[52] U.S. Cl. ..... 112/455; 112/315

[58] Field of Search ..... 112/314, 315, 453, 443, 112/455

[56] References Cited

U.S. PATENT DOCUMENTS

| | | | |
|---|---|---|---|
| 4,191,120 | 3/1980 | Bergvall | 112/443 |
| 4,299,180 | 11/1981 | Kume et al. | 112/455 |
| 4,563,966 | 1/1986 | Sano | 112/455 |

*Primary Examiner*—Peter Nerbun

*Attorney, Agent, or Firm*—Alfred E. Miller

[57] ABSTRACT

The feeding length in a sewing machine depends on the difference between the positions of the feeder when it rises above the stitch plate and when it sinks again. In previous devices the feeder is controlled by the angular position of a guide which is kept constant during the feeding phase. According to the invention the angular position of the guide can be re-adjusted during the feeding movement. At the moment when the feeder rises above the stitch plate the angular position determines a portion of the feeding length, while the angular position at the moment when the feeder sinks again determines the rest of the feeding length.

8 Claims, 2 Drawing Figures

ELECTRONIC FANCY SEWING MACHINE HAVING MEANS FOR ADJUSTING THE DRIVING MEANS OF A CLOTH FEEDER DURING A FEEDING PHASE

The present invention relates to an electronic sewing machine, particularly to a control arrangement of a cloth feeder in the machine.

Electronic sewing machines store stitch data for stitch width and stitch length, respectively, in a digital form. This means, the resulting stitch length of the feeding movement is usually not continuously setable but only adjustable in a number of discrete lengths, in other words, the resolution is finite. This is obvious by the use of stepping motors which are suitable for digital systems and allow simple system solutions. A previously known arrangement which provides an infinite resolution for the feeding movement is described in the U.S. Pat. No. 4,191,120 but that arrangement has the drawback of requiring separate analog adjustment means in its use. However, an improvement of the resolution of the feeding by a factor 2 can be attained by a digital control system in accordance with this invention. This improvement is the result of the present invention which is based on the following theory.

The feeding length is the movement the feeder performs from the moment it rises above the stitch plate to the moment it sinks below the stitch plate. In a conventional sewing machine the feeder is controlled by the angular position of the guide. According to the invention this angular position can be adjusted during the feeding movement. At the moment when the feeder rises the angular position determines one portion of the feeding movement and when it sinks the present angular position determines the rest of the feeding movement.

An embodiment of an arrangement according to the invention will be described in the following with reference to the accompanying drawings which show in FIG. 1 a vertical projection of the rear side of a sewing machine when the rear wall is removed and certain parts are excluded, FIG. 2 a vertical projection of a stepping motor driving arrangement in the sewing machine.

Figure 1:
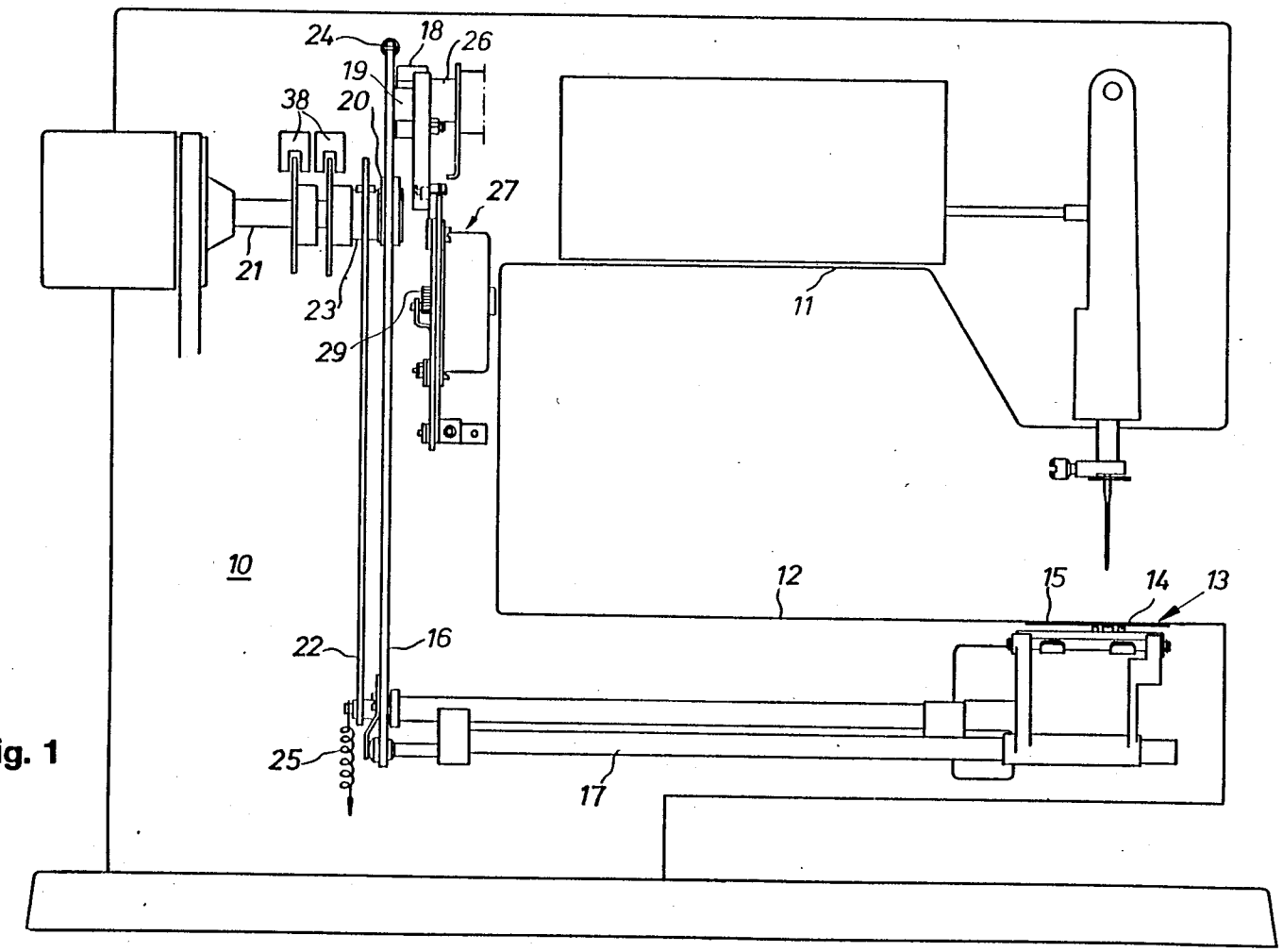
Figure 2:
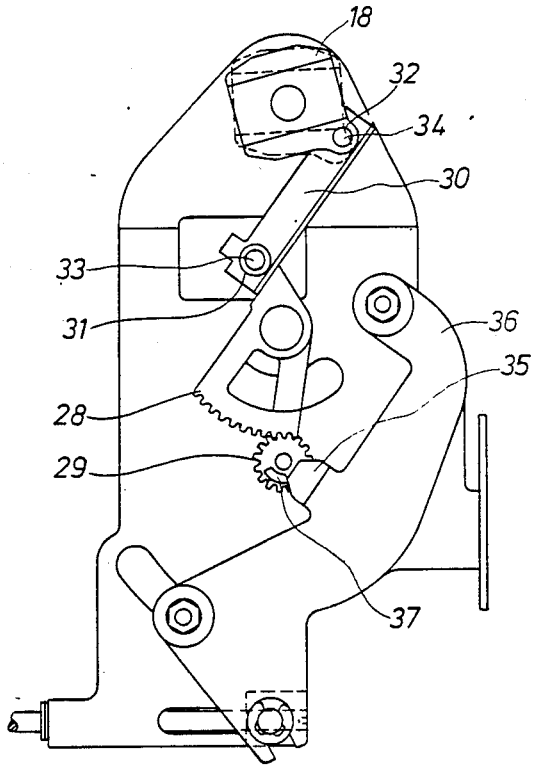

The main parts of the sewing machine, the stand 10, the upper and lower arm 11, 12 and drive elements and transmissions can be seen in FIG. 1. In the lower arm a shuttle mechanism 13, a feeder 14 and a stitch plate 15 are arranged as in a conventional sewing machine. The feeder which performs a largely rectangular movement comprises two driving elements, one for the horizontal movement and one for the vertical movement. The horizontal movement, which should be variable, is brought about by a linkage system 16, 17, a controllable guide 18 with a block 19 and an eccentric driving element 20 on the upper arm axle 21 of the machine which generates the feed movement. The vertical movement is constant and is brought about by a second linkage system 22 and a further eccentric driving element 23 on the upper arm axle, which generates an upward movement. The driving elements 20, 23 are single acting and the return movements are achieved with the help of springs 24, 25.

The controllable guide 18 is supported by an axle 26 and can be set into different angular positions in accordance with the set of stitches that is to be sewn. For the setting of the guide a stepping motor unit 27 and a movement transmission arrangement are provided in the machine. The stepping motor is of the electromagnetic type and comprises a gear 29 from which the step movements for the transmission arrangement are taken off. The latter consists of a gearing 28 and a coupling bar 30 provided on opposite ends with holes 31, 32, in which a crank pin 33 and an axle journal 34, respectively, are inserted. The coupling bar can transmit push as well as pull movements. The stepping of the stepping motor is responsive to digital pulses which are generated in an electronic unit in the sewing machine.

In the embodiment shown an end stop is formed by a peg 35 projecting in the holder 36 of the stepping motor and cooperating with a toothed sector 37 in the gearing between the motor and the coupling. The setting of the motor in this position, which constitutes the end position, takes place in such a way that the electronic unit emits a number of digital pulses which cause the motor to step towards the stop; after such a series of pulses the motor is calibrated, that is to say, it is set in the initial position. When the electronic unit subsequently emits a certain digital code, the motor responds in that it executes a corresponding number of steps from the initial position.

From the foregoing it is evident that the working movement of the stepping motor consists of a number of steps of a determined size. It may first be assumed that the guide is controlled in such a way that every step makes a change of the feeding length of 1 mm. Supposing that the motor is in a position for 1 mm feeding during a whole working cycle of the machine, the feeding up to the moment when the block 19 reaches the center of the guide will be 0.5 mm and further 0.5 mm after that.

In the introduction it was mentioned that the angle of the guide can be changed during the feeding movement. Keeping the position on 1 mm feeding and driving the machine until the block reaches the center of the guide the same feeding as in the foregoing example is repeated, i.e. 0.5 mm. Then, it may be assumed that the motor is moved a step upwards to 2 mm feeding. By continuation of the driving the feeder makes a movement of 1 mm which makes a total feeding movement of 1.5 mm, i.e. the sum of the feeding before the center position of the block in the guide and the movement after the center position. By the re-adjustment of the guide the feeding portions can be independent of each other and the resolution of the feeding movement thus be decreased into 0.5 mm. This is an improvement by a factor of 2.

The practical embodiment of the invention depends on the electronic unit having a stitch memory with data for the feeding movement. At predetermined angles of the upper arm shaft 22, detected by an upper arm sensor 38, a signal is emitted to the stitch memory which thereby supplies its data to the driving circuit of the stepping motor. The memory contains positions and data for the first feeding portion as well as the second portion, and the sensor 38 determines the time for releasing the code of the first portion and after that the code of the second portion. In FIG. 2 the position of the guide during the first portion is drawn in continuous lines and its position during the second portion is drawn in dashed lines.

I claim:

1. In an electronic fancy sewing machine with a stepping motor arrangement, including a stepping motor, for adjustment of the driving means of a cloth feeder wherein the stepping motor arrangement includes an angularly adjustable member, the length of feed of the cloth feeder for each step of the stepping motor being a function of the angular position of the adjustable member; the improvement comprising means for adjusting the adjustable member during a feeding phase to have a first angular position when the cloth feeder engages cloth being sewn and another angular position when the cloth feeder disengages the cloth.

2. Electronic fancy sewing machine according to claim 1, wherein the first and the second angular positions are adjacent steps of the stepping motor arrangement.

3. Electronic fancy sewing machine according to claim 1, wherein the means for adjusting the adjustable member from the first angular position to the second angular position during the feeding phase comprises an angular sensor in driving means of the machine, for supplying a signal during a feeding phase.

4. Electronic fancy sewing machine according to claim 1, wherein the adjustable member comprises a guide with an associated block.

5. Electronic fancy sewing machine according to claim 4, wherein the guide during a feeding phase occupies two angular positions adjusted by the adjusting means in dependence of pattern data circuits provided in the machine.

6. Electronic fancy sewing machine according to claim 4, wherein the guide with the associated block movable on both sides of the center of the guide is adjusted in angular positions corresponding to two successive steps of the stepping motor.

7. Electronic fancy sewing machine according to claim 6, wherein a first portion of the feeding phase includes a displacement of the block from an end position in the guide to its center during an adjustment of the guide on one of the angular positions, and a second portion of the feeding phase includes a displacement of the block from the center to a second end position in the guide during an adjustment of the guide on the second one of the angular positions.

8. Electronic fancy sewing machine according to claim 7, wherein the pattern data circuits are connected to an angular sensor in the driving means of the machine for supplying a signal at the middle of the feeding phase.

* * * * *